United States Patent [19]

Conken

[11] 4,185,444

[45] Jan. 29, 1980

[54] ALUMINUM PACK TREE

[76] Inventor: Chester S. Conken, 20195 SE. Highway 212, Boring, Oreg. 97009

[21] Appl. No.: 790,452

[22] Filed: Apr. 25, 1977

[51] Int. Cl.[2] ..... B68C 1/00

[52] U.S. Cl. ..... 54/37

[58] Field of Search ..... 54/37, 40, 42, 44

[56] References Cited

U.S. PATENT DOCUMENTS

| | | | |
|---|---|---|---|
| 39,285 | 7/1863 | Gosker et al. | 54/37 |
| 865,661 | 9/1907 | Szameitat | 54/44 |

FOREIGN PATENT DOCUMENTS

| | | | |
|---|---|---|---|
| 23622 | of 1905 | United Kingdom | 54/44 |
| 26753 | of 1906 | United Kingdom | 54/37 |

*Primary Examiner*—Russell R. Kinsey
*Assistant Examiner*—Robert P. Swiatek
*Attorney, Agent, or Firm*—Chernoff & Vilhauer

[57] ABSTRACT

A pack tree for distributing the weight of a load between the front and rear haunches of a pack animal. A lightweight, partially deformable carrier frame is mounted in pivotal spaced relation upon a pair of lightweight, partially deformable sideplates to provide a versatile pack tree useable with any of a wide range of pack animals and having a multiplicity of tie-down points. Retaining rings disposed upon the carrier frame provide reinforcement for the frame thereby limiting its deformation under loading.

4 Claims, 4 Drawing Figures

ALUMINUM PACK TREE

BACKGROUND OF THE INVENTION

The present invention relates generally to a pack tree for transporting items upon the back of a pack animal and more particularly to a pack tree deformably adaptable for distributing the weight of a load between the front and rear haunches of horses, mules, burros, dogs, llamas and other pack animals.

The use of animals for transporting loads in the form of heavy objects contained within saddlebags, packs and other containers predate the present invention by centuries and numerous devices have heretofore been presented for distributing the weight of such loads between the front and rear haunches of pack animals. Several factors, however, have heretofore combined to preclude complete adaptability of conventional pack trees for use with a wide range of pack animals.

Protection of the pack animal necessitates a pack tree designed to concentrate the load on the parts of the back proximate the spine since these parts are more capable of bearing the strain than are the more sensitive side portions. The anatomical configuration of pack animals vary widely, however, not only among the various species, but also within a particular breed. More importantly, the anatomical configuration of a particular animal undergoes periodical changes due to growth, weight changes, muscular motion and uneven terrain. These variations necessitate pack tree construction suitable for deformably adapting to a wide range of forms yet having sufficient resilient strength to provide the prerequisite weight allocation.

Several pack trees have heretofore been known which provide a potential solution to the difficulty of carefully allocating a load by setting forth manually adjustable frames adapted to receive particular loads. Notable examples include: Anderson U.S. Pat. No. 549,420; Schaller U.S. Pat. No. 893,199; and Bader et al U.S. Pat. Nos. 1,239,755 and 1,239,756. It should be particularly noted that such devices make no provision for automatically adjusting the weight load as is required under working conditions. Moreover, these relatively heavy and complex pack trees obtain this limited adaptability and load allocation at the expense of reducing the load-carrying capacity of the pack animal.

An alternative approach, Morgan U.S. Pat. No. 751,324, avoids some of the excessive load-carrying reduction inherent to complex pack trees by providing a relatively uncomplex, combination pack and riding saddle consisting of opposing pads and at least one transverse pommel connected at respective end portions of the pads connecting them together, the pommel consisting of a horizontal loop portion at its upper end, divergent limbs at its lower portion and an integral neck connecting the loop and limbs. This device, however, is extremely limited in the number of tie-down points provided and in its ability to adapt to the wide range of back configurations presented by various pack animals. More importantly, the forms of pommel construction suggested by Morgan either tend to separate under load since no reinforcement is provided for the pommel to limit deformability or lack substantial adaptability to divergent back configurations. It is particularly important to note that elongate wood pads, such as those suggested by Morgan, must have substantial cross section in order to support a load. Accordingly, such members are unduly heavy and unable to automatically adapt to changing back configurations since their inherent rigidity precludes flexing-type partial deformation both longitudinally and transversely relative to their longest dimension. The absence of such flexing action is particularly undesireable since it permits galling of the pack animal.

Many of the objections to the Morgan pack tree are also present in the pack tree described in Swanson U.S. Pat. No. 1,928,839 which is comprised of a pair of transverse bows pivotally connected at respective end portions of a pair of sideplates. The relatively complex hinging mechanisms of the Swanson device permit some adaptability to divergent back configurations of the pack animals but unduly increase production efforts and costs. More importantly, unless relatively heavy bows are used, the device will tend to deform under load since no provision is readily available to reinforcingly limit bow deformation under loading. Swanson also recites heavy and inflexible wood bows; thus, although the pivoting action permits some automatic transverse adjustments, it fails to recognize the need for flexing deformational adjustments as are necessitated by uneven terrain, muscular interplay, varying back configurations and the like. Further, the Swanson pack tree also severely limits the number of available tie-down points.

SUMMARY OF THE INVENTION

The present invention avoids the above-described difficulties by providing a lightweight pack tree which is deformably adaptable to the configuration of horses, mules, burros, llamas, dogs and other pack animals and having an uncomplex structure which is readily and economically manufactured.

The pack tree of the present invention includes a pair of elongate, generally flat sideplates having a carrier frame pivotally mounted thereon connecting the sideplates together, both of which being of flexible, partially deformable material. In lieu of the wood sideplates heretofore known, the aluminum sideplates of the present invention have sufficient strength characteristics to permit a relatively small cross section thereby providing a significant weight reduction and automatic flexing action both longitudinally and transversely relative to the longest dimension of the sideplates. The superior water resistance and heat conductivity characteristic of aluminum, as contrasted with wood, serves to prevent the localization of heat adjacent the sideplates. It is particularly important to note that initial tests indicate that this feature will significantly reduce the high incidence of galling heretofore experienced with pack trees. Moreover, a portion of the significant savings in weight can be utilized to permit use of five pound Mohair blankets or the like to achieve improved air circulation adjacent the sideplates thereby further decreasing the localization of heat.

In lieu of being limited to the transverse bows and loops provided by Morgan and Swanson, the carrier frame of the present invention includes portions extending along in spaced relation above the partially deformable sideplates. This important feature provides a multiplicity of tie-down points around the periphery of the pack tree. The multiple tie-down feature facilitates the use of any strapping system ranging from the relatively uncomplex systems required for small pack animals to the more complex cross strapping system described herein. Moreover, the flat sideplates are curved at both of their ends and pivotable to present a flat, ski-like configuration to a working surface. The durability of the metal sideplates permits this feature to combine with the cross strapping to permit emergency use of the pack tree as a saddle, game skid, ski carrier and back pack. In the latter instance, it should be noted that the pack tree is readily adaptable to the back of a person.

It is also important to note that the frame member portion extending along the sideplates also extend through bores formed in spaced-apart brackets. The diameter of the respective bores exceeds the diameter of the tubular carrier frame members, thereby permitting pivoting movement between the frame members and sideplates so as to adapt the sideplates to the sides of the pack animal without thereby necessitating the relatively complex pivotal assemblies required by the Swanson pack tree. The brackets preferably comprise thick wall tubing heliarc welded to the sideplates for maintaining the frame member portions in spaced relation above the sideplates without thereby structurally weakening the sideplates.

Each respective end of the carrier frame defines an upwardly extending, generally omega-shaped portion transversely extending from one end portion of the first sideplate to the corresponding end portion of the second sideplate. It is important to note that this construction permits partial deformability of the carrier frame under loading thereby providing supplemental adaptability. Unlike the transverse bows of the Swanson and Morgan pack trees, the omega-shaped portions of the present invention have ring members disposed thereon which serve as reinforcing members to limit deformation of the frame member under loading.

It is therefore a principal objective of the present invention to provide a versatile and improved pack tree adaptable for use with a wide range of types of pack animals.

It is a principal advantage of the present invention to provide a pack tree of lightweight design and inexpensive manufacture having a multiplicity of tie-down points thereon for accommodating a wide variety of strapping for securing to various types of pack animals.

It is a principal feature of the present invention to provide a pack tree having pivotable sideplates and a partially deformable but reinforced carrier frame for providing adaptability, heretofore unknown, to a variety of pack animal types.

The foregoing and other objectives, features and advantages of the invention will be more readily understood upon consideration of the following detailed description of the invention, taken in conjunction with the accompanying drawings.

DETAILED DESCRIPTION OF THE INVENTION

Figure 1:
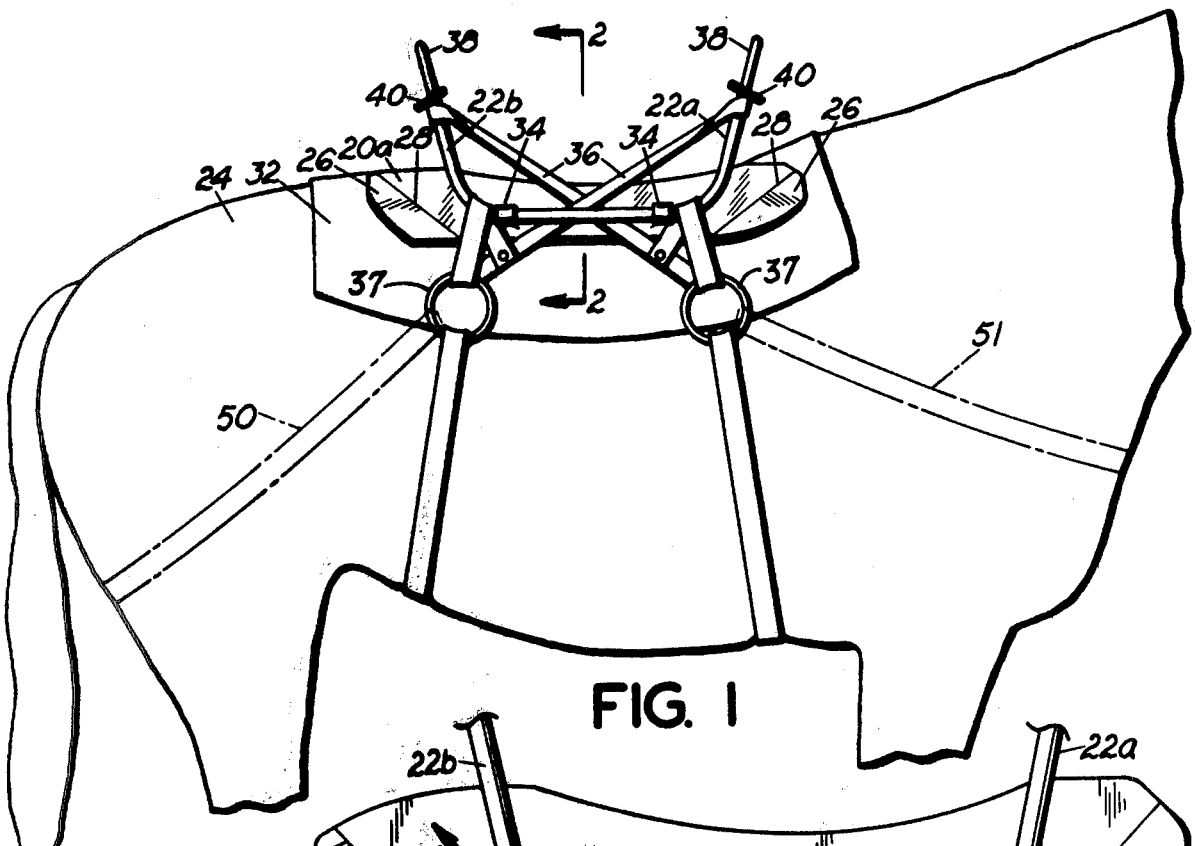
FIG. 1 is a side view of the pack tree of the present invention tied down upon the back of a pack animal.
Figure 3:
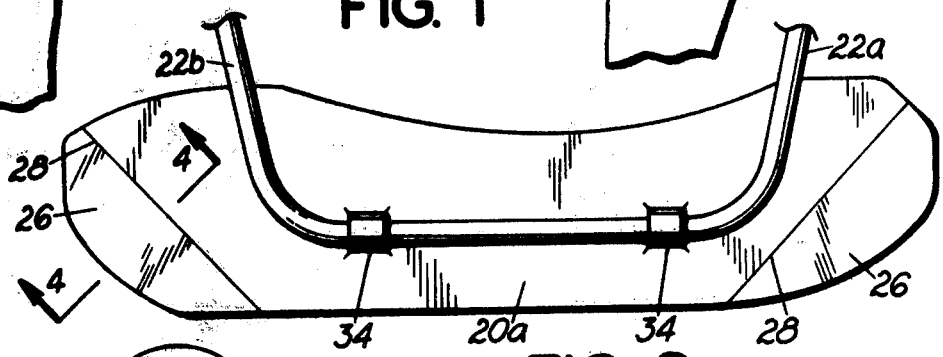
FIG. 3 is a side view of a sideplate of the present invention taken along lines 3—3 of FIG. 2.
Figure 2:
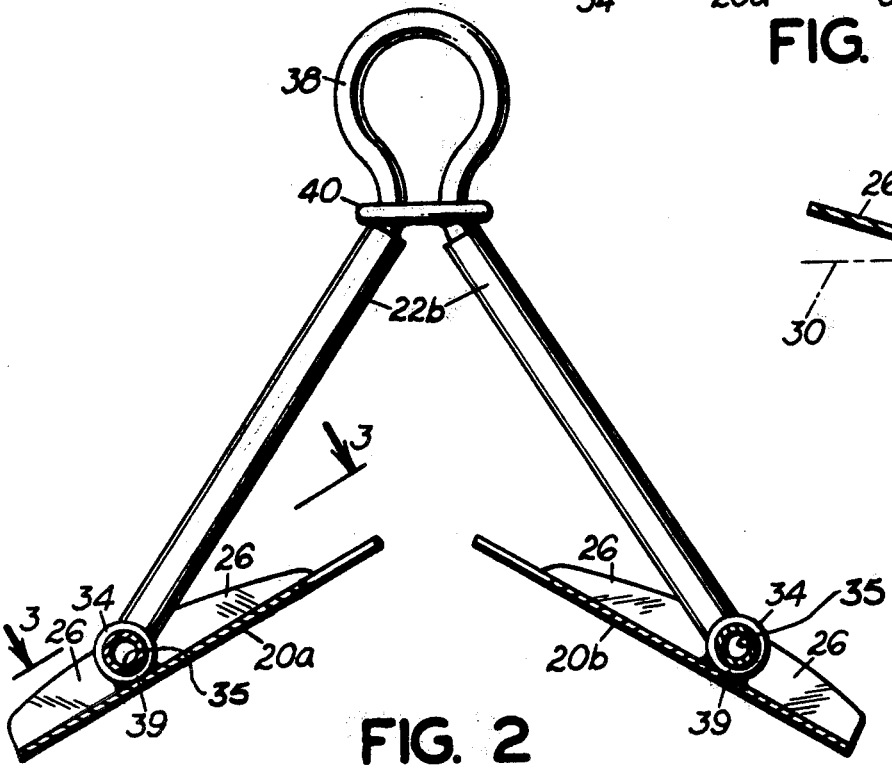
FIG. 2 is an expanded end view of the pack tree of the present invention taken along lines 2—2 of FIG. 1.
Figure 4:
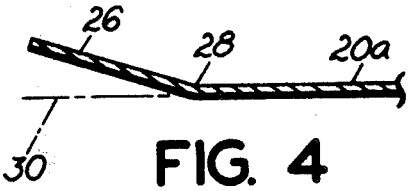
FIG. 4 is an expanded partial cross section of the sideplate of the present invention taken along lines 4—4 of FIG. 3.

Referring to the figures, the pack tree embodiment of the present invention is seen to comprise a pair of generally-flat, elongate plates **20*a* and 20*b* and a pair of upturned carrier frame members 22*a* and 22*b*** mounted on the plates so as to extend upwardly therefrom.

Each plate **20*a* and 20*b* has sufficient strength, configuration and cross-sectional area so as to be suitable for distributing the weight of one or more loaded saddlebags or the like between the front and rear haunches of a pack animal 24**. More particularly, each plate is composed from a lightweight durable material which is partially deformable under load both longitudinally and transversely relative to its longest dimension so as to more effectively use the weight-carrying capabibility of, and permit automatic flexing adaptability of the pack tree to the anatomy of, horses, burros, mules, dogs, llamas and other types of pack animals.

It has been found that aluminum, e.g. one-eighth inch thick sheets of 60–61 aluminum alloy, is particularly suitable for this application. Although other materials having comparable mechanical strength, flexing and weight characteristics could be used in lieu of aluminum; such material should have thermal conductivity in the Metals Range (5 to 220 (BTU/hr, F, $ft^2$/ft at 5° F.) in order to prevent the localization of heat intermediate the sideplates and the back of the pack animal.

A feature of the present pack tree is the provision of slightly upturned portions 26 adjacent each end of the weight distributing plates **20*a* and 20*b*. When the plates are composed from a lightweight metal the upturned portions are formed by folding the plates along respective foldlines 28 upwardly relative to the plate plane 30. Alternatively, each plate could be molded so as to have a generally flat bottom surface with upturned ends proximate the foldlines 28. One advantage provided by the upturned portions is that, when a blanket 32** is interposed between the plates and the pack animal, relative motion can occur between the relatively rigid plates and the pack animal's haunches without chafing or galling the animal. The upturned portions also combine with the generally flat sideplates to form a durable ski-like skid when the sideplates are pivoted so as to have their lower surface contiguous with a working surface.

Each carrier frame member **22*a* and 22*b* is elongate, having sufficient length to permit it to extend from a first plate 20*a* to the opposing plate 20*b* and sufficiently upward from the plates to define a suitable weight carrying area intermediate the frame members. Further, between the upraised portions of the respective members 22*a* and 22*b*** there is defined a space or void at the front and rear portions of the pack tree which permits straps or britchings to be connected thereto.

In the preferred embodiment of the present pack tree, the carrier frame members **22*a* and 22*b* are formed from a single lightweight rod, e.g. ⅜ inch, solid aluminum rod, which extends longitudinally for more than one-half of the length of each plate 20*a* and 20*b*, transversely from the right-hand plate 20*a* to the left-hand plate 20*b*, and upwardly from the plates so as to define in cross-section a hollow, generally omega-shaped member. The rod 38 is connected in two places to each of the plates using spaced-apart retention brackets 34 each having a bore 35 formed therethrough so as to permit the plates to pivot relative to the rod and to provide a space 39** intermediate the rod and the top surface of the plates. The brackets are formed by heli-arc welding sections of thick-wall tubing upon the upper surface of the sideplates so as to avoid any structural weakening of the sideplates and to facilitate construction of the pack tree.

The fact that the plates pivot or hinge relative to the perpendicular plane of the carrier frame provides the relatively rigid structure with sufficient flexibility as to permit adaptability of the pack tree to the anatomy of a wide range of pack animals. Additionally, the spacing 39 intermediate the rod and plates provides an infinitely variable number of tie-down points and thus permits the use of tie-downs ranging from the relatively simple straps and britching required for small pack animals to the more complex straps and britching illustrated in FIG. 1. The britching 50 and the breast strap 51 are useable as shown or, alternatively, can be adapted to permit use of the pack tree as a snow sled, game skid or backpack. A pair of cross straps 36 and four harness rings 37, two on each side of the pack animal, secure the belley bands, the britching and breast strap to the carrier frame to insure proper adaptability to the animal's configuration. Additionally, the cross straps provide supplemental support leather which permit use of the pack tree as a saddle. Accordingly, these features combine to provide an universal pack tree having versatility not heretofore available. Even greater versatility is obtained by using a partially deformable construction for the top portions of the carrier frames 22*a* and 22*b*. In the embodiment shown, a piece of aluminum rod 38 has been bent to define an omega shape and a ring 40 has been positioned about the end of the rod. The omega-shaped rods are thereafter connected to the carrier frame to provide additional lashing points. One suitable method of connecting is the provision of suitable-sized bores in the solid rod of the carrier frame and the insertion therein of the ends of the omega-shaped rods and their securement therein by heli-arc welding, rivets, cotter pins or the like. It is particularly important to note that the ring 40 provides reinforcement to the carrier frame members 22*a* and 22*b* so as to permit partial deformability of the pack tree up until a limit while preventing excessive deformation thereof.

The terms and expressions which have been employed in the foregoing abstract and specification are used therein as terms of description and not of limitation, and there is no intention, in the use of such terms and expressions, of excluding equivalents of the features shown and described or portions thereof, it being recognized that the scope of the invention is defined and limited only by the claims which follow.

What is claimed is:

1. A pack tree for supporting and distributing the weight of a load between the front and rear haunches of a pack animal, said pack tree comprising:

(a) a pair of elongate sideplates each having substantially flat upper and lower surfaces, a front portion and a rear portion;

(b) a pair of retaining members each comprising a pair of spaced apart retention brackets, each of said brackets being mounted on the upper surface of a respective one of said sideplates adjacent a respective one of said front and rear portions thereof and having a bore formed therethrough in parallel relation to the longest dimension of said sideplate;

(c) a pair of generally C-shaped frame members each pivotably extending through the bores of a respective one of said retaining members and each said frame member having its ends extending upwardly from the upper surface of one of said sideplates;

(d) a pair of generally omega-shaped partially deformable loop members, a first one of said loop members having its ends connected to the respective ends of said frame members extending upwardly from said front portions of said sideplates and a second one of said loop members having its ends connected to the respective ends of said frame members extending upwardly from said rear portions of said sideplates;

(e) a pair of reinforcing rings, a first ring disposed on said first loop member intermediate the ends thereof and a second ring disposed on said second loop member intermediate the ends thereof, so as to limit deformation of said loop members under loading; and (f) flexible strap means for providing additional load support, and for attaching belly bands and britching and breast straps to said pack tree for use of said pack tree on pack animals of different sizes, said flexible strap means comprising first and second pairs of connecting means, with one pair on each side of the pack animal, for connecting said belly bands and britching and breast straps to said flexible strap means, and similar but oppositely oriented first and second strap members movably fastening said first and second pairs of connecting means to said pack tree; said first and second strap members each comprising first and second strap loops interconnected by an elongate portion, said first strap loop of said first strap member being disposed about both a first one of said first pair of connecting means and a first one of said frame members near said front portion of a first one of said pair of sideplates, said elongate portion extending from said first strap loop upwardly between said ends of said first one of said frame members and further being looped around the respective ends of said frame members extending upwardly from said rear portion of said sideplates and being crossed over itself between said upwardly extending ends of said frame members, said elongate portion further extending downwardly on the other side of the pack animal between said ends of said second one of said frame members to said second strap loop of said first strap member, said second strap loop being disposed about both a first one of said second pair of connecting means and a second one of said frame members near said front portion of the second one of said pair of sideplates, said second strap member being oppositely disposed with respect to said pack tree, having first and second strap loops disposed respectively about a second one of each of said pairs of connecting means and a respective frame member near said rear portions of respective ones of said sideplates, and having an elongate portion looped around the respective ends of said frame members extending upwardly from said front portion of each of said sideplates and crossing over itself between said upwardly extending ends of said frame members.

2. The pack tree of claim 1 wherein said sideplates, said frame members and said loop members are of partially deformable metal.

3. The pack tree of claim 1 wherein said retention brackets include spacer means for spacing said frame members away from said upper surfaces of said sideplates thereby providing multiplicity of tie-down points along said frame members.

4. The pack tree of claim 1, wherein said loop members are of partially deformable material of greater flexibility than said frame members.

* * * * *